US008415940B2

(12) United States Patent
Yin et al.

(10) Patent No.: US 8,415,940 B2
(45) Date of Patent: Apr. 9, 2013

(54) TEMPERATURE COMPENSATION CIRCUIT AND METHOD FOR GENERATING A VOLTAGE REFERENCE WITH A WELL-DEFINED TEMPERATURE BEHAVIOR

(75) Inventors: Yi Yin, Munich (DE); Ralf Reuter, Munich (DE)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 12/991,820

(22) PCT Filed: Jun. 18, 2008

(86) PCT No.: PCT/IB2008/052400

§ 371 (c)(1), (2), (4) Date: Nov. 9, 2010

(87) PCT Pub. No.: WO2009/153618

PCT Pub. Date: Dec. 23, 2009

(65) Prior Publication Data

US 2011/0080154 A1 Apr. 7, 2011

(51) Int. Cl.
*G05F 3/16* (2006.01)

(52) U.S. Cl.
USPC ..... 323/314; 327/513

(58) Field of Classification Search ..... 323/312, 323/313, 314; 327/512, 513
See application file for complete search history.

(56) References Cited

U.S. PATENT DOCUMENTS 4,370,546 A * 1/1983 Warner ..... 219/497
5,129,049 A 7/1992 Cuzzo et al.
6,118,264 A 9/2000 Capici
6,137,341 A * 10/2000 Friedman et al. ..... 327/513
6,799,889 B2 * 10/2004 Pennock ..... 374/178
7,161,440 B2 * 1/2007 Meltzer ..... 331/76
7,167,058 B2 * 1/2007 Meltzer ..... 331/76
2007/0152649 A1 7/2007 Liu

FOREIGN PATENT DOCUMENTS

EP 1566717 A 8/2005
WO 97/42556 A 11/1997

OTHER PUBLICATIONS

Meyer Robert G et al: "A 1-GHz BiCMOS RF Front-End IC" IEEE Journal of Solid-State Circuits, vol. 29, No. 3, Mar. 1994, pp. 350-355.
Widlar Robert J: "Low Voltage Techniques" National Semiconductor, Technical Paper 14, Dec. 1978, pp. 1-10.
Varshni YP: "Temperature Dependence of the Energy Gap in Semiconductors" Physica 34, Department of Physics, University of Ottawa, Ottawa, Canada, pp. 149-154, 1967.

(Continued)

*Primary Examiner* — Adolf Berhane

(57) ABSTRACT

A temperature compensation circuit, comprises a temperature sensor circuit. The circuit comprises two or more temperature sensitive devices. In use, the devices are operated at different current densities and sense virtually the same ambient temperature. The devices provide temperature dependent signals having linear components with slopes of identical signs. The circuit further comprises one of more differential signal providing device for generating a difference of the signals generated by the temperature sensitive devices. A method for generating a voltage reference with a well-defined temperature behavior, comprises applying different current densities to two or more temperature sensitive devices of a temperature sensor circuit; sensing virtually the same ambient temperature with the two or more temperature sensitive devices. Each temperature sensitive devices generates a slightly different temperature dependent signal; and provide at least one differential signal based on said temperature dependent signals.

20 Claims, 6 Drawing Sheets

OTHER PUBLICATIONS

Reuter Ralf et al: "A 77 GHz (W-band) SiGe LNA with a 6.2 dB Noise Figure and Gain Adjustable to 33 dB" IEEE Bipolar/BiCMOS Circuits and Technology Meeting, 7.2, Oct. 2006, Germany, pp. 1-4.

International Search Report and Written Opinion correlating to PCT/IB2008/052400 dated Jan. 26, 2009.

* cited by examiner

-PRIOR ART-

-PRIOR ART-

−PRIOR ART−

−PRIOR ART−

–PRIOR ART–

TEMPERATURE COMPENSATION CIRCUIT AND METHOD FOR GENERATING A VOLTAGE REFERENCE WITH A WELL-DEFINED TEMPERATURE BEHAVIOR

FIELD OF THE INVENTION

This invention in general relates to electronic devices, and more specifically to a temperature compensation circuit and method for generating a voltage reference with a well-defined temperature behavior.

BACKGROUND OF THE INVENTION

The electromagnetic spectrum is divided into frequency bands. For example, the W-band of the electromagnetic spectrum ranges from 75 to 110 GHz. It resides above the V-band (50-75 GHz) in frequency, yet overlaps the NATO designated M-band (60-100 GHz). The W-band is used for radar research, military radar targeting and tracking applications, as well as for non-military applications such as automotive radar receivers.

Unfortunately, the power gain of integrated circuits designed to work in these frequency bands is subject to considerable variations due to changes of the ambient temperature either caused by the application itself or by changing temperature conditions of the surrounding atmosphere or neighboring devices.

As an example, FIG. 1 schematically shows a chip block diagram of a 77 GHz car radar receiver 100, which consists of 4 main building blocks: a low noise amplifier (LNA) 102 with a control input 104 and a signal input 122, a fully differential Gilbert mixer with passive balun 106 and terminals 108 for applying frequency adjustment capacitance, a baseband intermediate frequency buffer 110 with output terminals 112 providing an intermediate frequency signal, and a doubler block 114 with a doubler 116 and a 38 GHz buffer amplifier 118 with local oscillator input/output terminals 120. The LNA may be implemented based on Silicon Germanium (SiGe) bipolar technology. Here the power gain of the LNA might vary considerably with temperature. It can be expected that the gain decreases by about as much as 10 dB with a temperature increasing from −40° C. to +125° C. At the same time, the noise performance of the LNA decreases with rising temperature, i.e. the noise figure $NF_{LNA}$ of the LNA increases. As it can be seen from eq. 1, the total noise figure of the whole system increases with increasing $NF_{LNA}$. Furthermore, $NF_{total}$ mainly depends on $NF_{LNA}$ for high LNA gains $G_{LNA}$ (typically more than 10 dB).

Total system noise figure:

$$NF_{total} = NF_{LNA} + \frac{NF_{mixer} - 1}{G_{LNA}} + \frac{NF_{Baseband} - 1}{G_{LNA} G_{mixer}} \quad \text{(eq. 1)}$$

In which $G_{mixer}$ represents the gain of the mixer, $NF_{mixer}$ the noise figure of the mixer and $NF_{baseband}$ the noise figure of the baseband components.

The low noise amplifier 102 shown in FIG. 1 is the first active stage of the receiver 100 and determines the overall system performance. In order to achieve sufficient gain of the LNA, two common emitter cascode stages with one buffer stage are cascaded. FIG. 2 shows a schematic diagram of a cascode circuit 200 based on SiGe HBT (heterojunction bipolar transistors) 202, 204, with matching networks at the transistor input and output, realized by microstrip transmission lines 206-218 used to convey the microwave-frequency signals plus capacitors and resistors 220-232 for DC decoupling and low pass filtering. The circuit comprises inputs for a received signal 234, supply voltages $V_{CAS}$ 238 and $V_{CC}$ 240 and for an additional bias voltage $V_{B1}$ 242 and output 236 to the next stage.

In car radar receiver systems as shown in FIG. 1, the temperature dependence of the total conversion gain is an important factor. Since phase and amplitude information of the intermediate frequency IF-signal can be used to detect objects (car, walls, pedestrians), a receiver with temperature dependent gain that spoils detection results is a disadvantage.

In order to avoid wide amplitude variations in the output signal leading to a loss of information or to an unacceptable performance of the system, AGC (automatic gain control) circuits are usually employed in baseband to control the output signal, if the gain variation is considerably large.

W-band LNAs can be designed based on SiGe bipolar technology, e.g. a 0.18 μm SiGe technology, providing cutoff frequencies $f_{max}/f_T$ about 290/200 GHz at room temperature. But temperature dependent variation of $f_T$ and $f_{max}$ is quite large for such a device. Hence, the power gain of such an LNA varies considerably with respect to temperature.

In order to obtain a low variation of gain and system noise figure within the mentioned wide temperature range a car radar system has to deal with, bias voltages for both cascode stages and output buffer stage can be applied, as shown in FIG. 2 for a cascode stage. An optimized relationship between ambient temperature and these bias voltages can be derived. An optimized solution can be obtained, for example, by applying the noise measure method (a compromise between gain and noise), as mentioned in "A 77 GHz (W-band) SiGe LNA with a 6.2 dB Noise figure and Gain Adjustable to 33 dB", Reuter, R., Yin Y., IEEE Bipolar/BiCMOS Circuits and Technology Meeting, 7.2, October 2006, pp: 1-4. An example of desired optimized bias voltages for the first and second stage $V_{B1}$ (310) and output buffer stage $V_{B2}$ (312) are illustrated in FIG. 3. Both voltages show a linear dependence over temperature and a small negative temperature coefficient in the range of −0.42 mV/° C. and −0.67 mV/° C., respectively.

In order to apply voltages that approximate these desired bias voltages 310, 312, allowing for optimized temperature compensation, a DC voltage reference may be established with a temperature behavior suitable for compensating the temperature behavior of the LNA circuit. In state-of-the-art LNA designs, as described in "A 1-GHz BiCMOS RF Front-End IC", R. Meyer and W. Mack, IEEE Journal of Solid State circuit, vol. 29, No. 3, pp. 350-355, March 1994, the proportional-to-absolute-temperature (PTAT) compensation principle is commonly used (R. J. Widlar, Low voltages techniques, IEEE Journal of Solid-State Circuits, 13(6):836-846, December 1978). A schematic diagram of a basic PTAT compensation circuit 400 is shown in FIG. 4. A PTAT current is generated by using the difference in forward voltage appearing across a resistor when two diode-connected transistors (402 and 404) are operated at different current densities. This results in a difference voltage generating a PTAT current in resistor 406. The PTAT current is mirrored into transistor 408 and resistor 410, and by adjusting resistor 410 to the correct multiple K of resistor 406 the desired $V_{REF}$ over temperature can be achieved, where the forward voltage of diode-connected transistor 408 is the inverse of PTAT, or complementary-to-absolute-temperature (CTAT), and the CTAT of base-emitter voltage $V_{BE}$ of transistor 408 and PTAT voltages are compensated. PMOS-transistors 412-416 are used for current supply and mirroring, operational amplifier 418 adjusts the gate voltage of the PMOS devices 412-416 so as to equalize the voltage levels at its positive and negative input terminals. The basic PTAT compensation principle is shown in FIG. 5. A temperature dependent PTAT voltage is provided and compensated with a CTAT voltage with negative temperature coefficient, resulting in a linear compensated reference voltage. In FIG. 5 the basic PTAT principle is shown. Since generally in semiconductors, the relationship between the flow of electrical current and the electrostatic potential across a p-n junction depends on a characteristic voltage called the thermal voltage, it is denoted $V_T$=kT/q, where q is the magnitude of the electrical charge (in coulombs) on the electron, and k the Boltzmann constant. In FIG. 4, a PTAT voltage $V_T$ is the temperature dependent $V_{BE}$ voltage of transistor 402, whereas a CTAT $V_{BE}$ voltage in FIG. 5 relates to $V_{BE}$ voltage of transistor 408.

However, it is well known that the base-emitter voltage $V_{BE}$ of a diode-connected bipolar transistor comprises a non-linear term (cf. Varshni, Y. P., "Temperature dependence of the energy gap in semiconductors", Physica, 1967, 34, pp. 149-154):

$$V_{BE}=V_{go}+\alpha T+f(T^2) \quad \text{(eq. 2)}$$

$V_{go}$ is the silicon band-gap voltage at zero Kelvin; $\alpha$ depends on the current density of the diode-connected bipolar transistor; $f(T^2)$ represents the second-order nonlinearities in the base-emitter voltage. Thus, with the state-of-the-art PTAT compensation method and circuit illustrated in FIG. 4 higher order dependencies cannot be cancelled. Practically, when a plot of the reference voltage $V_{REF}$ (T) provided by the PTAT compensation circuit against temperature T is expected to have a rather small slope, the second-order non-linearity will play a significant role, as shown in FIG. 6, hence an approximation of the desired linear relationship between bias voltage and temperature is difficult.

U.S. Pat. No. 6,118,264 discloses a complex approach to producing a voltage reference having a temperature compensation on second order events by providing a band-gap reference voltage circuit based on a Brokaw cell for producing a band-gap voltage reference and a compensation voltage approximating the band-gap voltage over temperature, wherein the sum of both voltages partly reduces the influence of second order events.

U.S. Pat. No. 5,129,049 discloses a temperature compensated reference voltage generation circuit that uses different current sources, one with increasing current, another one with decreasing current as temperature increases, for approximation of a voltage change across a resistor with respect to temperature.

SUMMARY OF THE INVENTION

The present invention provides a temperature compensation circuit, a method for generating a voltage reference with a well-defined temperature behaviour, a low noise amplifier and, a vehicle radar device as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale.

DETAILED DESCRIPTION OF THE PREFERRED EMBODIMENTS

Figure 7:
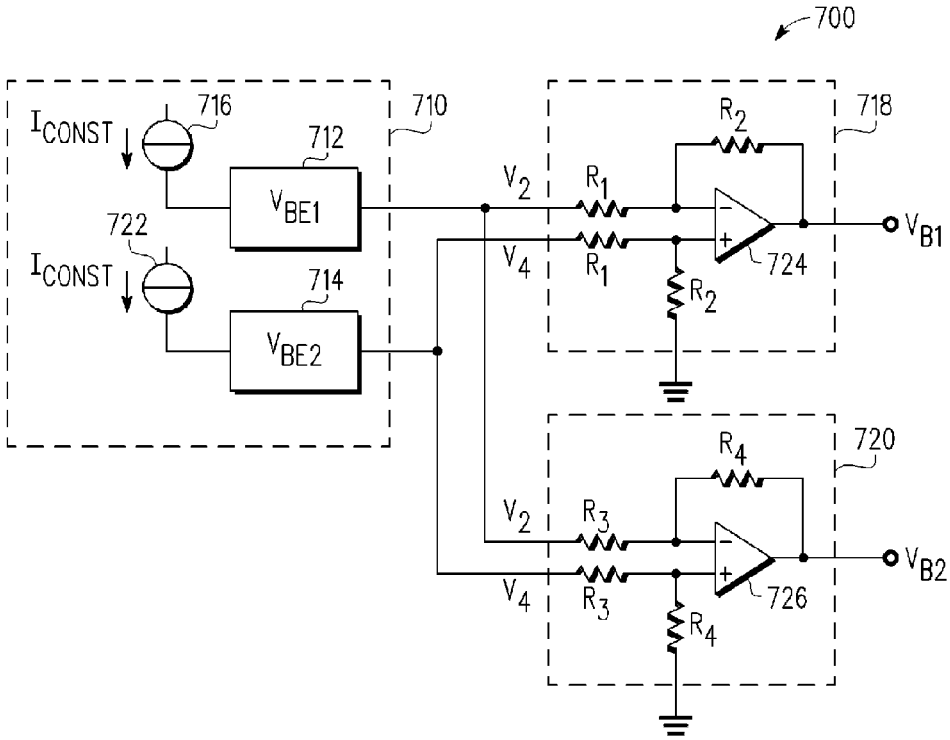
FIG. 7 schematically shows an example of an embodiment of a temperature compensation circuit in accordance with the present invention that could be used for W-band LNA.

Referring to FIG. 7, an example of an embodiment of a temperature compensation circuit 700 is shown. It comprises a temperature sensor circuit 710 containing two or more temperature sensitive devices 712, 714 operated at different current densities sensing virtually the same ambient temperature and providing temperature dependent signals having linear components with slopes of identical signs, and at least one differential signal providing device 718, 720 generating a difference of the temperature dependent signals generated by the temperature sensitive devices. In this document, the term "virtually" is to be understood as "suitable for the specific intent and purpose". For example, "virtually the same temperature" sensed by two different devices located next to each other implies that for practical purposes the temperature sensed may be regarded as the same, even if the means are not located at exactly the same place and therefore cannot sense exactly the same ambience.

The circuit 700 is capable of generating a voltage reference with a well defined temperature behavior, virtually avoiding non-linear terms being part of the output voltage $V_{B1}$ and $V_{B2}$, respectively. The shown two differential signal providing devices 718, 720 each process a signal difference between the output voltages $V_1$ and $V_2$ of the shown temperature sensor 710 and provide a compensation output voltage $V_{B1}$ and $V_{B2}$, respectively. The term "$V_B$" suggests $V_B$ to be applied, for example, as a bias voltage for a circuit to be connected, sharing virtually the same ambient temperature. The shown example of an embodiment of the temperature compensation circuit provides two output voltages $V_{B1}$ and $V_{B2}$, which is suitable for the application of the circuit for a temperature compensation of a W-band LNA comprising one or more cascaded cascode stages, each requiring a linear bias voltage $V_{B1}$ over temperature for optimized temperature compensation, and one output buffer stage requiring a linear bias voltage $V_{B2}$. Therefore, two differential signal providing devices 718, 720, having different gains, are provided, generating two bias voltages $V_{B1}$ and $V_{B2}$. In FIG. 7, the provision of current densities is symbolized by current sources 716, 722.

The differential signal providing device 718, 720 may be a differential amplifier configuration. The differential amplifier configuration 718, or 720 may comprise an operational amplifier (OPAMP) 724, or 726 and a plurality of at least two resistors $\{R_1, R_2\}$, or $\{R_3, R_4\}$, respectively, for tuning the gain of the configuration 718, or 720 by adjusting a resistance ratio of resistors $\{R_1, R_2\}$, or $\{R_3, R_4\}$. OPAMPs are easily available when realizing the compensation circuit as part of an integrated device. Furthermore, it effectively decouples a circuit that applies the generated output voltages $V_{B1}$ and/or $V_{B2}$ from the compensation circuit 700.

Figure 8:
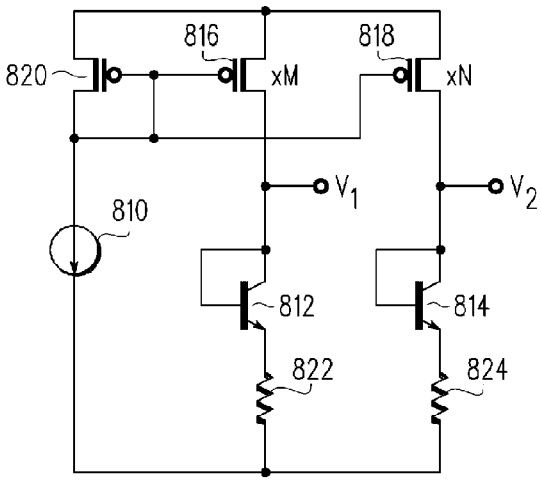
FIG. 8 schematically shows an example of an embodiment of a proposed temperature sensor circuit in accordance with the present invention.

Referring now to FIG. 7 and FIG. 8, the temperature compensation circuit 700 may contain a temperature sensor circuit 710 with two or more temperature sensitive devices 712, 714 operated under different current densities sensing virtually the same ambient temperature, each of which comprises a semiconducting device 812, 814 with a junction having a temperature dependent conductivity. This allows a conversion of temperature into an electrical signal directly on chip. A diode or a transistor could be used, for example. FIG. 8 shows an example of an embodiment of a proposed temperature sensor circuit using diode-connected bipolar transistors 812, 814 as temperature sensitive devices. n-p-n- or p-n-p-transistors may be used. Other semiconductive temperature sensitive devices or any combination of the abovementioned devices might be used, too.

The temperature dependent voltages $V_1$ and $V_2$ are provided by temperature sensitive devices 812, 814 operated at different current densities. These may be generated by metal oxide semiconducting devices 816, 818 with differing dimensions, connected to semiconducting device 820 and current source 810. In this way, the obtained dependence between the temperature sensitive voltages $V_1$ and $V_2$, which in FIG. 8 are the base-emitter voltages of transistors 812, 814, and temperature is slightly different. Resistors 822 and 824 are used to adjust the DC points for each temperature sensitive output voltage, respectively. The dimension of the metal oxide semiconducting devices can be a property of the device itself, e.g. its size, but can also relate to the number of devices used, each possibly with identical electrical properties. For an integrated circuit implementation, it may be convenient to have different numbers m and n of identical devices 816, 818 instead of different devices. For a compensation circuit for a W-band LNA, m/n may be 8, for example. The metal oxide semiconducting devices may be PMOS (p-channel metal-oxide semiconducting) devices. The usage of other technologies is possible (NMOS, CMOS, for example). The devices may be transistors.

A plot of the generated voltage reference against temperature may comprise at least one virtually linear section. The voltage reference, i.e. the output voltage $V_{B1}$, and $V_{B2}$, respectively, of the temperature compensation circuit 700 are generated by processing a difference of temperature dependent voltages possibly compensating contained non-linear components. The shown temperature compensation circuit 700 avoids temperature compensation with a PTAT circuit in order to reduce the influence of second-order non-linear terms (cf. eq. 2), which play a significant role, when the desired temperature coefficient of the used bias signals, i.e. a slope of a plot of $V_B$ against temperature, is quite low (−0.7 up to −0.4 mV/° C., for example). Instead of applying the PTAT method, the shown temperature compensation circuit connects the output terminals providing the temperature dependent voltages $V_1$ and $V_2$, which are the base-emitter voltages of diode-connected transistors 812, 814 shown in FIG. 8 with the corresponding inputs of the differential amplifiers 718, 720 with different gains. Therefore, the output voltages of the shown temperature compensation circuit 700 are given by:

$$V_{B1}=(V_1-V_2)R_2/R_1 \quad \text{(eq. 3)}$$

$$V_{B2}=(V_1-V_2)R_4/R_3 \quad \text{(eq. 4)}$$

$V_1$ and $V_2$ both contain a non-linear term $f(T^2)$ (cf. eq. 2). However, because the term $f(T^2)$ is present at both inputs of differential amplifier 718 and of differential amplifier 720, respectively, it is compensated as a common mode signal. In order to obtain the desired compensation output voltages $V_{B1}$ and $V_{B2}$, to be used as optimized bias voltages, the resistor pairs $R_1$ and $R_2$ for differential amplifier 718, and $R_3$ and $R_4$ for differential amplifier 720, respectively, may be adjusted accordingly.

Figure 9:
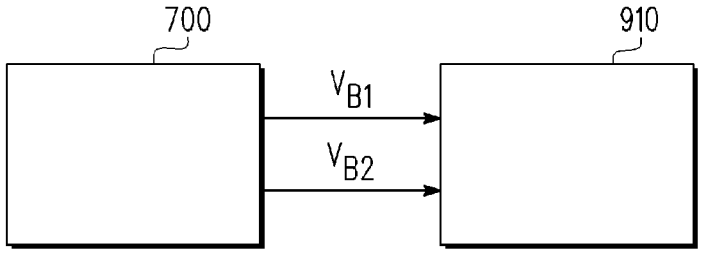
FIG. 9 schematically shows a block diagram of an example of an electronic circuit with a corresponding temperature compensation circuit.

Referring now also to FIG. 9, the voltage reference, i.e. $V_{B1}$ and $V_{B2}$ in the example shown in FIG. 7, may be used as a bias voltage for an electronic circuit 910 being subject to virtually the same temperature changes. The electronic circuit 910 and the compensation circuit 700 may be located on the same chip. Thus, the electronic circuit 910 experiencing variations in gain and noise due to the variations of temperature can apply the provided voltage reference, which is subject to virtually the same temperature influence and, especially if built on the same chip, provides virtually the same temperature characteristics, as a bias voltage, in order to achieve a temperature independent gain. The voltage reference may at least partially compensate for a gain variation of the electronic circuit 910. This allows for a better control of gain and noise performance of the electronic circuit, which effectively allows for a better production yield.

Figure 1:
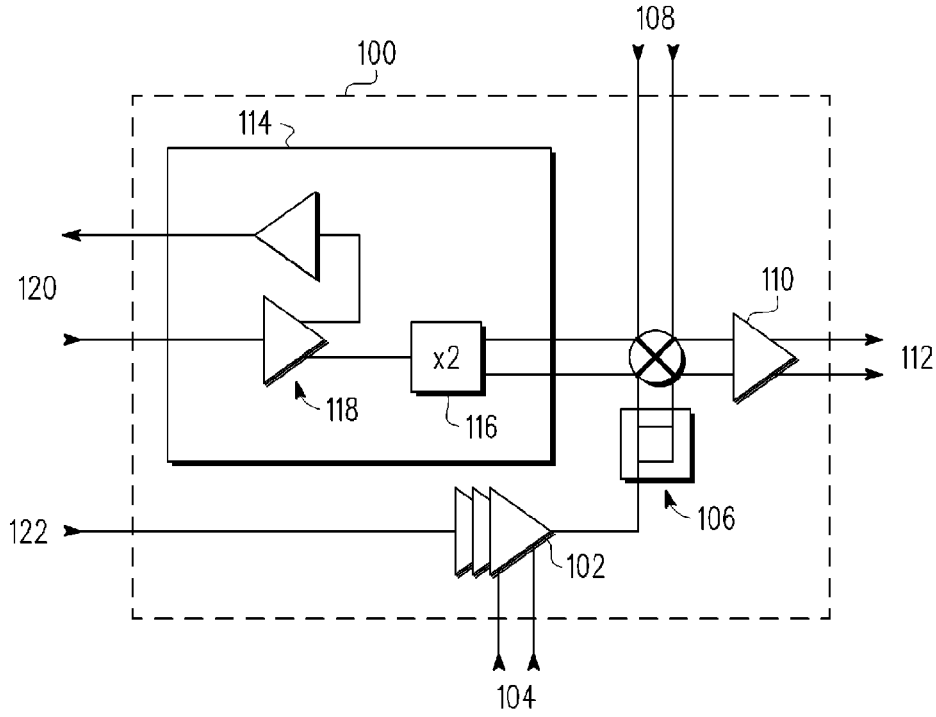
FIG. 1 shows a schematic block diagram of a state-of-the-art receiver (RX) that could be used in car radar applications.
Figure 2:
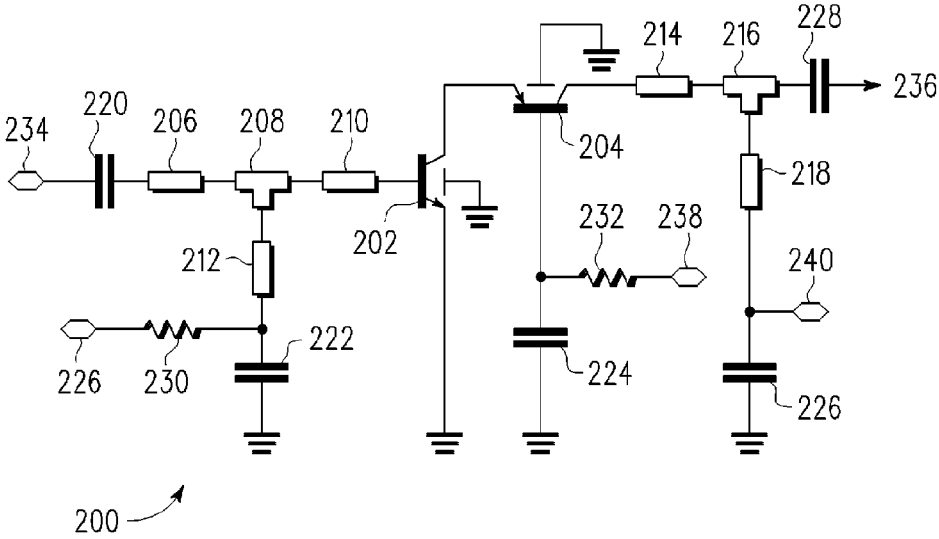
FIG. 2 illustrates a schematic diagram of a cascode SiGe-HBT stage with matching network implemented using microstrip transmission lines.
Figure 3:
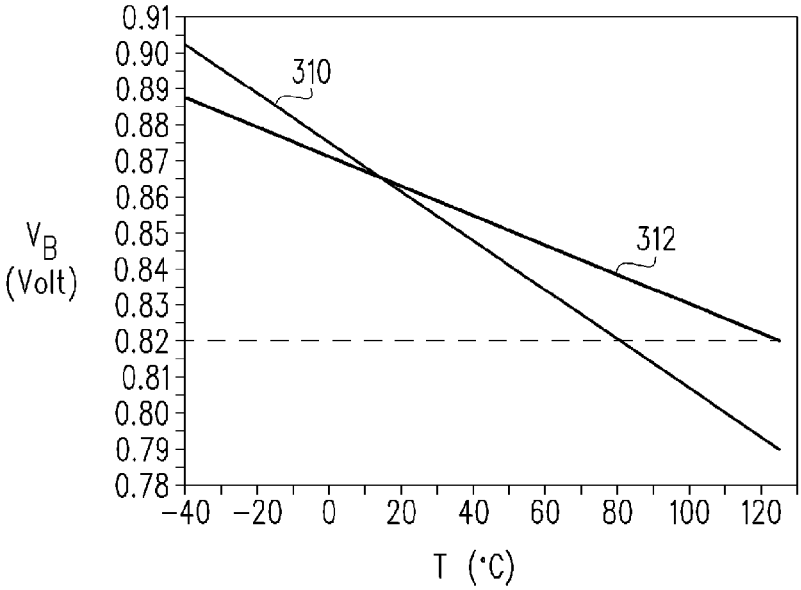
FIG. 3 shows an example of desired optimized bias voltages $V_{B1}$ and $V_{B2}$ over temperature for a 77 GHz LNA.
Figure 4:
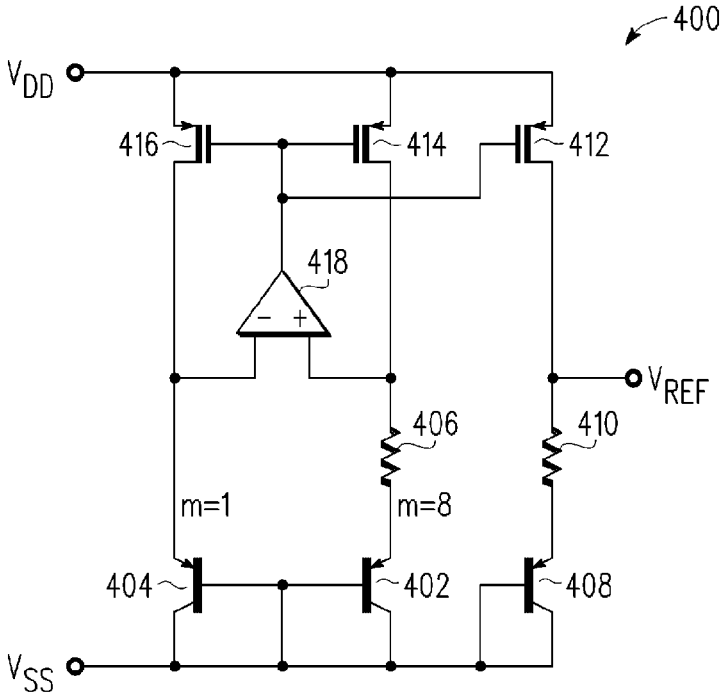
FIG. 4 shows a schematic diagram of a basic PTAT circuit.
Figure 5:
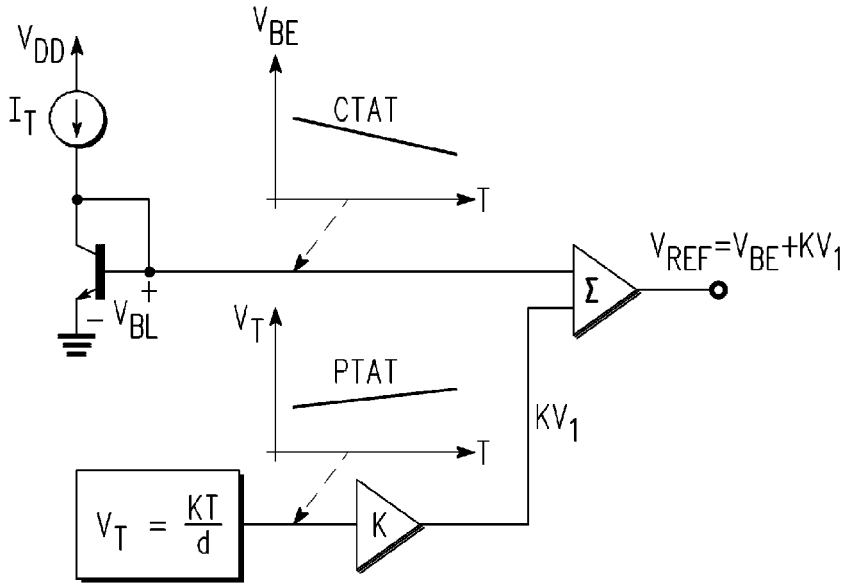
FIG. 5 shows a schematic illustration of the PTAT compensation principle.
Figure 6:
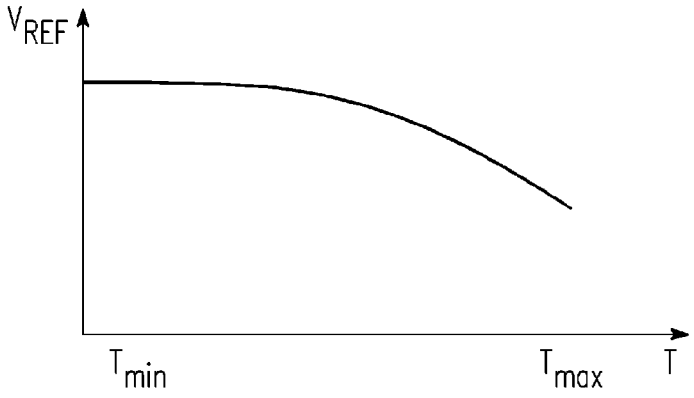
FIG. 6 shows a schematic diagram illustrating $V_{REF}$(T) behavior of a PTAT compensation circuit.

The electronic circuit 910 may, for example, be an electronic amplifier and be used in a radar system for example replacing the LNA 110 in the example of FIG. 1. Non-linear temperature dependencies are a problem that many RF telecommunications- and signal processing applications encounter, which may use an integrated electronic amplifier circuit as the first stage on the receiver side.

An electronic amplifier for microwave applications may often contain several stages, at least one amplifying stage followed by one output buffer stage. A typical amplifying stage consists of a cascode circuit compensating the Miller-effect and therefore allowing to apply high and very high frequency signals to the amplifier. Therefore, the bias voltage may be a bias voltage for at least one cascode stage 200 of the electronic amplifier 910. Some applications may require cascading two or more cascode stages in order to achieve a desired target gain. The shown temperature compensation circuit 700 is designed to provide bias voltages for all stages of an electronic amplifier 910, avoiding the need for multiple compensation circuits for multiple stages, reducing power consumption and required chip space. Thus, the temperature compensation circuit 700 for generating a voltage reference may comprise at least a second differential signal providing device 720 providing a second voltage reference being used as a bias voltage for a buffer stage following the at least one cascode stage 200 of the electronic amplifier 910.

The electronic amplifier 910 may be operable within a frequency range located between 50 and 120 GHz. Applications using radar signals are an example of applications working in that frequency range. The electronic amplifier may be a low noise amplifier (LNA), which is a special type of electronic amplifier or amplifier used in communication systems to amplify very weak signals while adding as little noise and distortion as possible. The described embodiment of the invention particularly relates to temperature compensation of 77 GHz low noise amplifiers for car radar applications. These applications may be implemented using bipolar transistors based on Silicon-Germanium semiconductor technology. However, any other semiconducting material and transistor technology may be used, as well. The well-defined reference voltages can be applied as bias voltages to an LNA, which was optimized by simulations to achieve the best compromize between gain, linearity and noise. The determined desired optimized temperature characteristics of the bias voltages for such a SiGe-Bipolar 77 GHz LNA present a particularity, namely a quite small fractional negative temperature coefficient (TC). The described compensation circuit allows for reducing the measured gain variation of the LNA in the temperature range from −40° C. up to 125° C. to less than ±1.5 dB.

Figure 10:
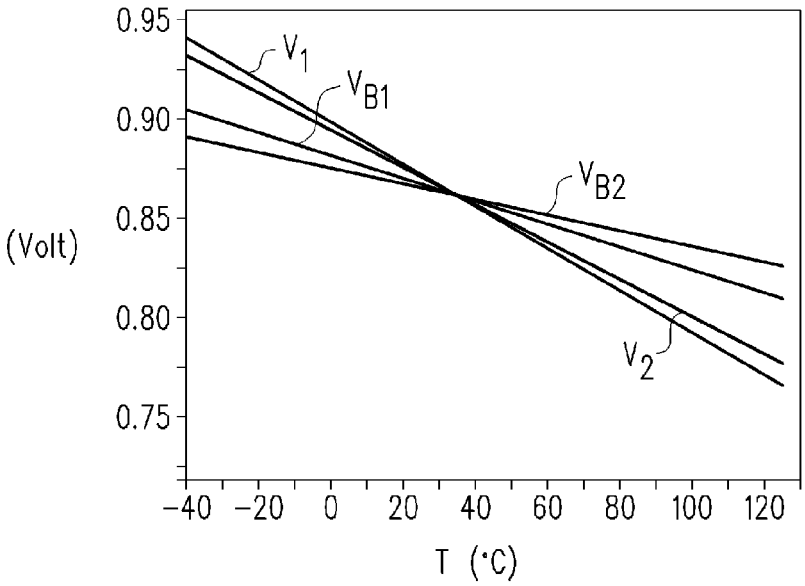
FIG. 10 shows an example of signed sensor voltages $V_1$ and $V_2$ and bias voltage $V_{B1}$ and $V_{B2}$ according to the circuit shown in FIG. 7.

Referring now to FIG. 10, an example of signed sensor voltages $V_1$ and $V_2$ and bias voltage $V_{B1}$ and $V_{B2}$ according to the circuit 700 shown in FIG. 7 is illustrated for a temperature compensated W-band LNA operated at 77 GHz. It can be seen that $V_{B1}$ and $V_{B2}$ are virtually linear over temperature T between −40 and +125° C., each having a different small negative temperature coefficient. Although in this example illustration V1 and V2 may appear to be linear over temperature, they generally may comprise a higher-order, non-linear component.

Figure 11:
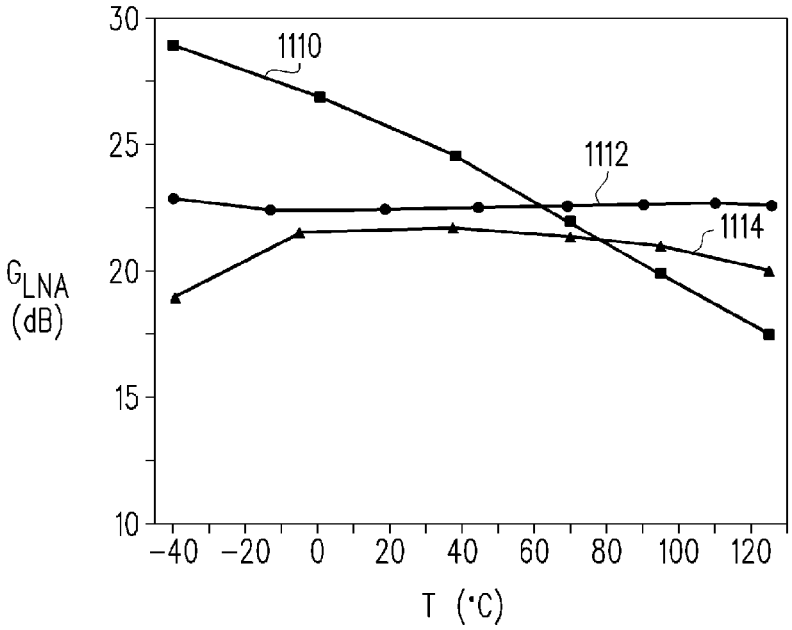
FIG. 11 shows an example of LNA gain variations over temperature with/without application of the compensation circuit shown in FIG. 7.

Referring now to FIG. 11, in order to illustrate the performance of the proposed compensation circuit for an example application, a 77 GHz LNA, standard biasing without any compensation and the new proposed biasing scheme have been simulated, designed and implemented. As shown in FIG. 11, without compensation, the measured gain variation $G_{LNA}$ over temperature T 1110 within a temperature range from −40° C. up to 125° C. may be in the range of 10 dB, with the invented compensation circuitry the gain variation over temperature 1114 may be about only in the range of ±1.5 dB. Although as the first implementation of LNA on silicon, the gain variation 1114 is slightly higher than the 1112 simulated ±0.5 dB, the compensation effect can still be easily seen, especially between 5° C. and 85° C.

Figure 12:
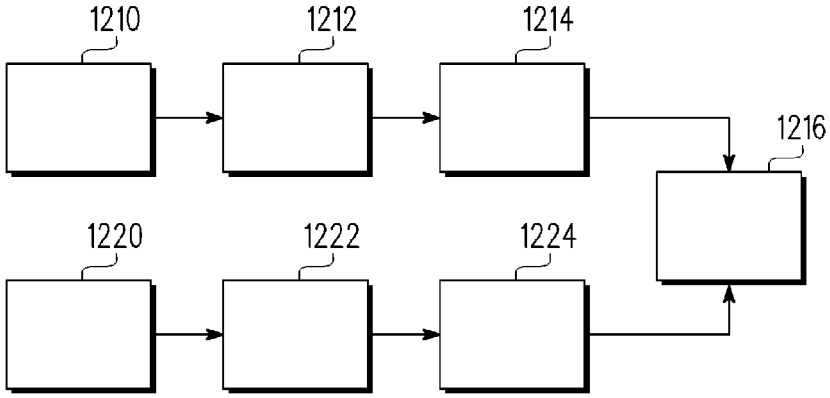
FIG. 12 schematically shows a flowchart illustrating an example of an embodiment of a temperature compensation method in accordance with the present invention.

Referring now to FIG. 12, a flowchart illustrates an example of an embodiment of a temperature compensation method in accordance with the present invention. A method for generating a voltage reference with a well-defined temperature behavior is shown, comprising applying 1210, 1220 different current densities to two or more temperature sensitive devices 712, 714 of a temperature sensor circuit 710, sensing 1212, 1222 virtually the same ambient temperature with the two or more temperature sensitive means, each temperature sensitive means generating 1214, 1224 a slightly different temperature dependent signal, and providing 1216 at least one differential signal based on the temperature dependent signals, wherein said temperature dependent signals all comprise linear components with slopes of identical signs.

The described method allows implementing the advantages and characteristics of the described invented temperature compensation circuit as part of a method for generating a voltage reference with a well-defined temperature behaviour. This also applies to the examples of embodiments of the invented method described below.

The temperature dependent signal used by this method may be generated from a temperature dependent conductivity of a junction of a semiconducting device 812, 814 of the temperature sensitive devices 712, 714.

The different current densities may be generated by metal oxide semiconducting devices 816, 818 with differing dimensions.

In an example of an embodiment of the invented method, a plot of the voltage reference against temperature may comprise at least one virtually linear section.

In an example of an embodiment of the invented method, the method may comprise using the voltage reference as a bias voltage for an electronic circuit being subject to virtually the same temperature changes.

The electronic circuit may be an electronic amplifier.

The usage of the voltage reference may at least partially compensate for a gain variation of the electronic circuit.

The bias voltage may be a bias voltage for at least one cascade stage of the electronic amplifier.

The method for generating a voltage reference may comprise, for example, generating at least a second voltage reference and using the second voltage reference as a bias voltage for a buffer stage following the at least one cascode stage of the electronic amplifier.

While the principles of the invention have been described above in connection with specific apparatus, it is to be clearly understood that this description is made only by way of example and not as a limitation on the scope of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

The semiconductor substrate described herein can be any semiconductor material or combinations of materials, such as gallium arsenide, indium phosphide, gallium nitride, silicon germanium, silicon-on-insulator (SOI), silicon, monocrystalline silicon, the like, and combinations of the above.

The conductors as discussed herein may be illustrated or described in reference to being a single conductor, a plurality of conductors, unidirectional conductors, or bidirectional conductors. However, different embodiments may vary the implementation of the conductors. For example, separate unidirectional conductors may be used rather than bidirectional conductors and vice versa. Also, plurality of conductors may be replaced with a single conductor that transfers multiple signals serially or in a time multiplexed manner. Likewise, single conductors carrying multiple signals may be separated out into various different conductors carrying subsets of these signals. Therefore, many options exist for transferring signals.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Also for example, in one embodiment, the illustrated elements of circuit 700 are circuitry located on a single integrated circuit or within a same device. Alternatively, circuit 700 may include any number of separate integrated circuits or separate devices interconnected with each other.

Also for example, circuit 700 or portions thereof may be soft or code representations of physical circuitry or of logical representations convertible into physical circuitry. As such, circuit 700 may be embodied in a hardware description language of any appropriate type.

Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Also, the invention is not limited to physical devices or units implemented in non-programmable hardware but can also be applied in programmable devices or units able to perform the desired device functions by operating in accordance with suitable program code. Furthermore, the devices may be physically distributed over a number of apparatuses, while functionally operating as a single device. For example, compensation circuit 700 and electronic circuit 910 may be located on different apparatuses.

Also, devices functionally forming separate devices may be integrated in a single physical device. For example, compensation circuit 700 and electronic circuit 910 may be located on the same apparatus.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements The mere fact that certain measures are recited in mutually different claims does not indicate that a combination of these measures cannot be used to advantage.

The invention claimed is:

1. A temperature compensation circuit for generating a voltage reference with a well-defined temperature behavior, comprising:

a temperature sensor circuit, said circuit comprising;

two or more temperature sensitive devices which when operated have different current densities, for sensing virtually the same ambient temperature and providing temperature dependent signals having linear components with slopes of identical signs; and at least one differential signal providing device, for generating a difference of said signals generated by said temperature sensitive devices, said difference forming the voltage reference.

2. The temperature compensation circuit as claimed in claim 1, wherein said differential signal providing device is a differential amplifier configuration.

3. The temperature compensation circuit as claimed in claim 1, wherein said temperature sensitive devices comprises a semiconducting device with a junction having a temperature dependent conductivity.

4. The temperature compensation circuit as claimed in claim 1, wherein said different current densities are generated by metal oxide semiconducting devices with differing dimensions.

5. The temperature compensation circuit as claimed in claim 1, wherein said voltage reference is a virtually linear function of the temperature over at least some range of the temperature.

6. The temperature compensation circuit as claimed in claim 1, wherein said voltage reference is used as a bias voltage for an electronic circuit being subject to virtually the same temperature changes.

7. The temperature compensation circuit as claimed in claim 6, wherein said voltage reference at least partially compensates for a gain variation of said electronic circuit.

8. The temperature compensation circuit as claimed in claim 6, wherein said electronic circuit is an electronic amplifier.

9. The temperature compensation circuit as claimed in claim 8, wherein said bias voltage is a bias voltage for at least one cascode stage of said electronic amplifier.

10. The temperature compensation circuit as claimed in claim 9, wherein said temperature compensation circuit for generating a voltage reference comprises at least a second differential signal providing device providing a second voltage reference being used as a bias voltage for a buffer stage following said at least one cascode stage of said electronic amplifier.

11. The temperature compensation circuit as claimed in claim 8, wherein said electronic amplifier is operable within a frequency range located between 50 and 120 GHz.

12. A method for generating a voltage reference with a well-defined temperature behavior, comprising:

applying different current densities to two or more temperature sensitive devices of a temperature sensor circuit;

sensing virtually the same ambient temperature with said two or more temperature sensitive devices;

each temperature sensitive devices generating a temperature dependent signal; and providing at least one differential signal based on said temperature dependent signals, wherein said temperature dependent signals all comprise linear components with slopes of identical signs.

13. The method as claimed in claim 12, wherein said temperature dependent signal is generated from a temperature dependent conductivity of a junction of a semiconducting device of said temperature sensitive devices.

14. The method as claimed in claim 12, wherein said different current densities are generated by metal oxide semiconducting devices with differing dimensions.

15. The method as claimed in claim 12, wherein a plot of said voltage reference against temperature comprises at least one virtually linear section.

16. The method as claimed in claim 12, comprising:

using said voltage reference as a bias voltage for an electronic circuit being subject to virtually the same temperature changes.

17. The method as claimed in claim 16, wherein said electronic circuit is an electronic amplifier.

18. The method as claimed in claim 16, wherein said using of said voltage reference at least partially compensates for a gain variation of said electronic circuit.

19. A low-noise amplifier (LNA) comprising a temperature compensation circuit as claimed in claim 1.

20. A vehicle radar device comprising a low-noise amplifier as claimed in claim 19.

* * * * *